United States Patent [19]

Schiff

[11] 4,424,748

[45] Jan. 10, 1984

[54] SEGMENTED SEAL FOR DISCARDING SABOT AMMUNITION

[75] Inventor: Saul Schiff, Moline, Ill.

[73] Assignee: The United States of America as represented by the Secretary of the Army, Washington, D.C.

[21] Appl. No.: 290,898

[22] Filed: Aug. 7, 1981

[51] Int. Cl.[3] ..... F42B 13/16

[52] U.S. Cl. ..... 102/523; 102/501

[58] Field of Search ..... 102/501, 517, 518, 519, 102/520, 521, 522–527, 703

[56] References Cited

U.S. PATENT DOCUMENTS

| | | | |
|---|---|---|---|
| 3,107,615 | 10/1963 | Brady | 102/520 X |
| 3,496,869 | 2/1970 | Engel | 102/522 |
| 3,620,167 | 11/1971 | Romer et al. | 102/521 |
| 3,738,279 | 6/1973 | Eyre et al. | 102/521 |
| 3,771,458 | 11/1973 | Schweimler et al. | 102/523 |
| 3,981,246 | 9/1976 | Luther et al. | 102/521 |
| 4,249,466 | 2/1981 | Rossmann et al. | 102/521 |
| 4,296,687 | 10/1981 | Garrett | 102/523 |

*Primary Examiner*—Harold J. Tudor
*Assistant Examiner*—T. Davis
*Attorney, Agent, or Firm*—Robert P. Gibson; Anthony T. Lane

[57] ABSTRACT

A disc-like segmented elastomer seal utilizing tongue and groove construction for use with discarding sabot ammunition. Said seal may be used as the primary seal or in conjunction with a conventional base seal to prevent entry of propellant gases between the sabot and the subprojectile body particularly when firing in worn gun tubes. A second embodiment utilizes radially projecting spider arms to assure sealing of the gaps between the sabot segments.

1 Claim, 3 Drawing Figures

SEGMENTED SEAL FOR DISCARDING SABOT AMMUNITION

GOVERNMENT RIGHTS

The invention described herein may be manufactured and/or used by or for the Government for governmental purposes without the payment of any royalty thereon.

BACKGROUND OF THE INVENTION

Sabot projectiles are used when an oversized gun tube launches a subcaliber warhead. These projectiles have sabot petals or segments wrapped around the warhead and contact the bore of the gun tube during ejection. The sabot seals the bore to prevent escape of the propulsion gases during firing and then drops away from the warhead when it leaves the gun tube. One such projectile is an armor piercing, fin stabilized discarding sabot which has three sabot sections around a central core or body. These sections are held together with a front bourrelet and a band or obturator at the rear. A fin assembly stabilizes the central core in flight.

During firing, a gas tight seal is necessary between the discarding sabot and the subprojectile body within it. Gas leakage in this area greatly increases the potential for unstable launches and for projectile parts breakup. The latter condition can also result in damage to the gun tube. Any means utilized for obtaining such a seal, however, must not interfere with the subsequent separation of the sabot segments or with the flight of the projectile after it has left the gun tube.

At present, base seals are molded over the rear end of the sabot/core assembly. Generally, this type of seal works well except when firing through a worn gun tube. As the gun tube wears, the internal bore becomes enlarged. This permits some radial expansion of the sabot segments during firing. Frequently, this expansion is sufficient to rupture the conventional molded seal before the projectile has left the gun tube. The ruptured seal and displaced sabot segments permit the propulsion gases to flow between the core and the sabot segments, thus creating the undesireable conditions previously stated.

SUMMARY OF THE PRESENT INVENTION

In accordance with the present invention a discarding sabot projectile is provided with an inner seal between the sabot segments and the subprojectile body within the sabot. Suitable recesses are provided in the outer surface of the subprojectile and the inner surface of the segments to receive a disc-like elastomer seal to block entry of propellant gases between the body and sabot.

The inner seal consists of tongue and groove sections which mate to form the seal when the sabot segments are assembled to the body. The seal sections are designed to readily disengage when the sabot segments separate after leaving the gun tube. The seal sections, however, have adequate engagement to prevent gas leakage through the tongue and groove joints due to radial expansion of the sabot segments when firing in a worn gun tube.

In one embodiment each seal section has a radially extending spider arm and in another, it is omitted. The purpose of the spider arms are to seal the gaps where sabot segments separate. One advantage of the sectional seal over the conventional molded seal is that the spider arms can be made slightly oversize. The spider arms are then under a slight compression when assembled to the sabot and core. This assures a positive seal between the sabot segments even though some expansion may occur while the projectile traverses the gun tube.

The sectional inner seal may be used as the primary seal or in conjunction with the conventional molded seal.

DETAILED DESCRIPTION OF ILLUSTRATIVE EMBODIMENTS

Figure 1:
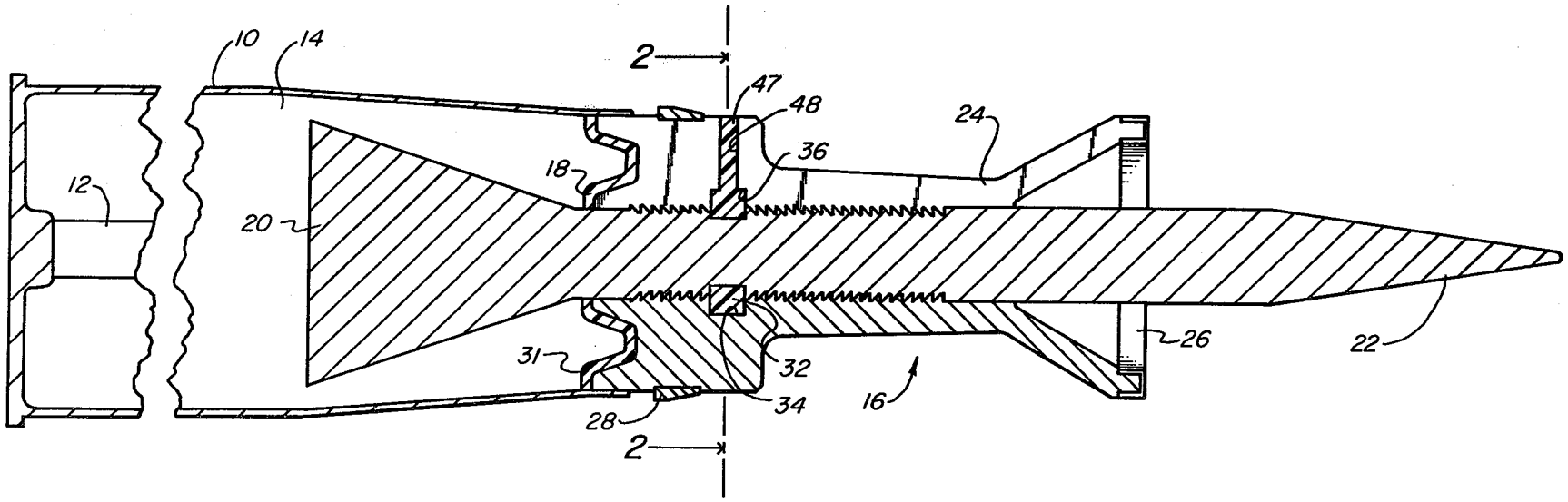
FIG. 1 is a longitudinal sectional view of the sabot projectile.

Reference is made to FIG. 1 wherein there is shown a projectile casing 10 housing an igniter 12, propellant 14, and a projectile 16. The projectile 16 consists of a core or body 18 having a fin assembly 20 for stabilization purposes, a windshield 22 to protect the warhead (not shown), and a sabot 24.

Figure 2:
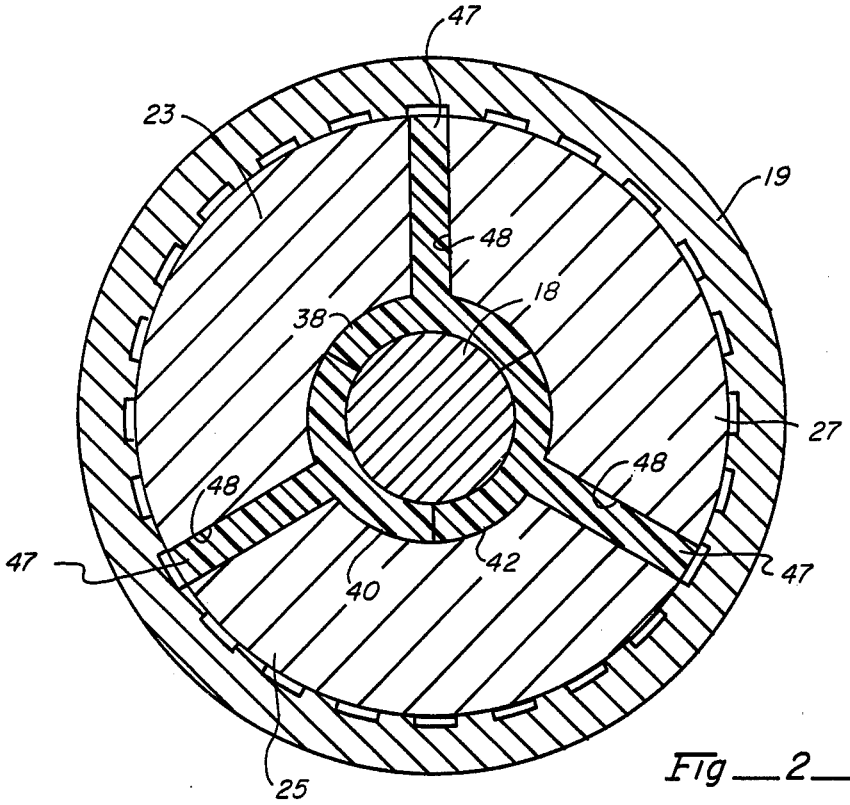
FIG. 2 is a cross sectional view taken along line 2—2 in FIG. 1 and, FIG. 3 is a perspective view of the tongue and groove seal segments.

The sabot 24 consists of three petals or segments 23, 25, and 27 which fit around the body 18 to support it as it is propelled through the gun tube 19 (see FIG. 2). The segments are held together around the body 18 by a bourrelet 26 at the front and a band or obturator 28 toward the rear. The interface between the body 18 and the sabot segments is notched in such a manner that the sabot segments carry the body 18 as the projectile 16 propels through the gun tube.

Normally, gas leakage between the sabot 24 and core 18 is controlled by a molded base seal 31 which covers the rearmost end of the sabot 24. However, when firing in worn gun tubes the conventional molded seal often fails because of radial expansion. Hot propulsion gases are then permitted to flow between the core 18 and the sabot 24 which quickly erodes the notched interface therebetween. As the notches are eroded, the engagement between the sabot 24 and the core 18 diminishes, often resulting in an unstable launch or breaking of the core 18 or other metal parts.

Figure 3:
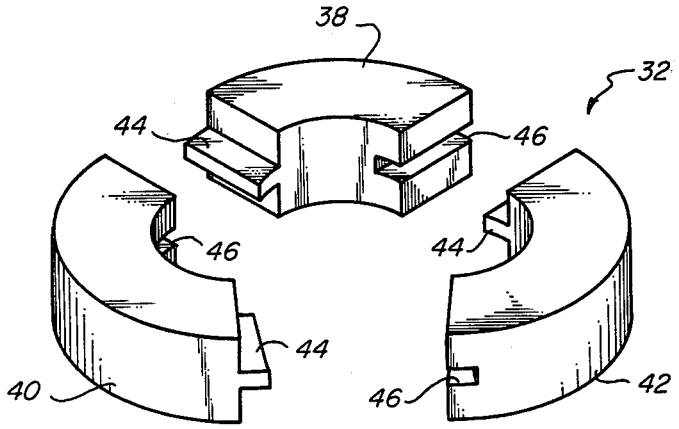

In accordance with the present invention a ring-like inner segmented seal 32 is provided to restrict the gas flow when firing in a worn gun tube. The seal 32 is received in recesses 34 and 36 in the sabot segments and core 18. As shown in FIGS. 2 and 3 the segmented seal 32 consists of three interlocking sections 38, 40 and 42. Each seal section is provided with tongue 44 and groove 46 interlocking construction. Each sabot segment has a corresponding seal section so as not to interfere with separation of the sabot after launch and to simplify assembly. Radial alignment of the sabot segments and seal sections is not critical, however. The twofold purpose of the segmented seal tongue and groove construction is to permit radial expansion of the sabot segments without compromising sealing capability and to cause clean, even separation from the subprojectile to take place after its job of sealing is done. The latter is essential for maximum flight accuracy. Conventional seals are molded over the base of the assembled sabot projectile 16. When firing in worn gun tubes, the radial expansion of the sabot segments frequently fractures such seals or otherwise causes loss of sealing ability. The tongue and groove joints in the segmented seal 32 however, have adequate engagement to maintain sealing even under the most extreme bore wear conditions. Further, the seal receiving recesses 34 and 36 in the sabot 24 and core 18 are of adequate depth to assure positive sealing even though the sabot segments may expand slightly during firing. This assures positive sealing in any serviceable gun tube.

In a second embodiment, each seal section is provided with a spider arm 47 to assure sealing at the point of separation of the sabot segments. The spider arms 47 extend radially from the seal sections and are received within grooves 48 in the face of the sabot segments. The spider arms 47 can be made slightly larger than the receiving grooves 48 so that they are under a slight compression when assembled. This permits some radial expansion of the sabot segments during firing without allowing gas leakage past the sabot separation points.

The invention in its broader aspects is not limited to the specific combinations, improvements and instrumentalities described but departures may be made therefrom within the scope of the accompanying claims without departing from the principles of the invention and without sacrificing its chief advantages.

I claim:

1. A subcalibre projectile having a segmented seal between its core and sabot, said projectile comprising:

a subcalibre projectile core, a discarding sabot having longitudinal petals encompassing said projectile core, said sabot and core having annular recesses therein, said seal fitting within said sabot and core recesses, said seal being radially expandable upon radial movement of said petals upon projection through a worn gun tube, said seal having a ring-like configuration formed from segmented interlocking sections having tongue and groove interfitting portions which interfit to form a ring whereby said seal is radially expandable without separation within said worn gun tube, said seal having spider arms extending radially therefrom and between segments of said sabot.

* * * * *